US010660500B2

(12) United States Patent
Krieger

(10) Patent No.: US 10,660,500 B2
(45) Date of Patent: May 26, 2020

(54) DISHWASHER DETERGENT DISPENSER WITH REDUCED NOISE

(71) Applicant: ILLINOIS TOOL WORKS INC., Glenview, IL (US)

(72) Inventor: Jeffrey J. Krieger, Mukwonago, WI (US)

(73) Assignee: Illinois Tool Works Inc., Glenview, IL (US)

( * ) Notice: Subject to any disclaimer, the term of this patent is extended or adjusted under 35 U.S.C. 154(b) by 305 days.

(21) Appl. No.: 15/670,433

(22) Filed: Aug. 7, 2017

(65) Prior Publication Data

US 2018/0168423 A1 Jun. 21, 2018

Related U.S. Application Data

(60) Provisional application No. 62/434,620, filed on Dec. 15, 2016.

(51) Int. Cl.

| | |
|---|---|
| ***A47L 15/44*** | (2006.01) |
| ***A47L 15/00*** | (2006.01) |
| *E05F 5/10* | (2006.01) |
| *E05F 5/00* | (2017.01) |

(52) U.S. Cl.

CPC ..... *A47L 15/4409* (2013.01); *A47L 15/0052* (2013.01); *A47L 15/4436* (2013.01); *A47L 2501/07* (2013.01); *E05F 5/003* (2013.01); *E05F 5/10* (2013.01); *E05Y 2900/304* (2013.01)

(58) Field of Classification Search

CPC ..... A47L 15/4409

See application file for complete search history.

(56) References Cited

U.S. PATENT DOCUMENTS

| | | | | |
|---|---|---|---|---|
| 4,418,931 | A * | 12/1983 | Howard | B62D 6/04 280/271 |
| 5,220,706 | A | 6/1993 | Bivens | |
| 7,270,135 | B2 | 9/2007 | Virgillia et al. | |
| 2010/0084885 | A1* | 4/2010 | Townson | E05D 11/084 296/57.1 |
| 2010/0275659 | A1* | 11/2010 | Son | D06F 39/02 68/17 R |
| 2016/0192820 | A1 | 7/2016 | Gadini et al. | |

FOREIGN PATENT DOCUMENTS

| | | | |
|---|---|---|---|
| DE | 20216589 | U1 | 1/2003 |
| DE | 202009012852 | U1 | 12/2009 |
| EP | 1260159 | A2 | 11/2002 |
| EP | 1723893 | A2 | 11/2006 |
| EP | 2775163 | A1 | 9/2014 |

OTHER PUBLICATIONS

European Search Report dated Dec. 3, 2018 as non-patent literature.

* cited by examiner

*Primary Examiner* — Jason Y Ko

(74) *Attorney, Agent, or Firm* — Boyle Fredrickson, S.C.

(57) ABSTRACT

A dishwasher detergent dispenser includes a viscous damper allowing a dispenser door to be preloaded with a sufficiently strong spring to overcome resistance caused by detergent encrustation and the like while significantly reducing noise caused by the door opening.

19 Claims, 4 Drawing Sheets

DISHWASHER DETERGENT DISPENSER WITH REDUCED NOISE

CROSS-REFERENCE TO RELATED APPLICATIONS

This application claims the benefit of U.S. provisional application 62/434,620 filed Dec. 15, 2016, and hereby incorporated by reference.

FIELD OF THE INVENTION

The present invention relates to automatic dishwashing machines (dishwashers) and in particular to dishwashers providing automatic dispensing of detergent during a wash cycle.

BACKGROUND OF THE INVENTION

Dishwashers, such as those found in many homes, provide a wash cavity holding one or more racks into which dishes, flatware, and the like may be placed for cleaning. The wash cavity may be sealed by a door opening at the front of the wash cavity to allow loading and unloading of the cavity. The door is closed during a washing cycle to prevent the escape of water sprayed within the volume of the wash cavity and used to wash items placed in the racks. Upon completion of the washing cycle, a drying cycle is initiated during which water is drained from the wash cavity and moist air is discharged through a vent or the like.

A washing session may include a prewash portion in which the dishes are rinsed without the application of detergent. Accordingly, most dishwashers provide for automatic detergent dispensing, for example, from an in-door dispenser, that can be automatically triggered after the pre-wash cycle at the time that the wash cycle begins.

Detergent may be placed in the dispenser in the form of a dried powder or a prepackaged detergent "pod". When powder is used, it is important that the dispenser mechanism be resistant to "caking" of the hygroscopic detergent that might interfere with the dispensing either by partially solidifying within the dispenser chamber or coating portions of the dispenser after the detergent is dispensed.

To reduce interference from detergent encrustation, the dispenser door is normally biased with an ample spring which may be set in compression by the user after the user places detergent in the dispenser and closes the door. The door is then released by an electromechanical actuator when it is time to dispense the detergent, the spring providing sufficient force to overcome minor interference.

The desired strong force of opening the dispenser door can result in a loud sound when the door is released and reaches the end of its travel. This can be counter to a manufacturer's desires to produce an unobtrusive and quiet appliance.

SUMMARY OF THE INVENTION

The present invention provides a viscous damper element compatible with the harsh environment of the dishwasher that may operate to limit the peak velocity of door movement and, in that way, to limit the sound created upon the door opening. The damper provides a piston supported on a shaft within a cylinder. When the door opens, motion of the piston conducts air through a narrow orifice to provide damping action. The cylinder is open at its end without a seal between the piston shaft and the cylinder such as could interfere with operation of the damper if the piston shaft became encrusted with detergent. The cylinder further opens downward facilitating drainage and allowing a self-scouring by the operation of the dishwasher. A check valve relieves pressure when the door is closed by the consumer to allow the door to be rapidly closed without damping action.

More specifically, in one embodiment, the invention provides a dishwasher detergent dispenser having a housing providing a detergent compartment with a door movable between a closed position and an opened position, the latter exposing a detergent compartment to the wash chamber for release of detergent. A spring element urges the door from the closed position to the opened position and an electrically controlled catch holds the door in the closed position against the urging of the spring element until activation and then releases the door to move the door to the opened position. A viscous damper is attached between the door and the housing to provide a damping force limiting opening speed of the door.

It is thus a feature of at least one embodiment of the invention to provide a method of reducing noise upon opening of the spring-loaded detergent dispenser door while providing a sufficiently strong spring to ensure opening in the face of possible resistance from caked or encrusted detergent. The viscous damper reduces speed of opening without affecting the static spring force.

The viscous damper may provide a reduced damping force limiting closing speed of the door, this reduced damping force being less than the damping force limiting the opening speed of the door.

It is thus a feature of at least one embodiment of the invention to allow the consumer to readily close the opened dispenser door after filling the dispenser with detergent while still providing noise reduction during door opening.

The viscous damper may be a pneumatic damper providing a piston fitting within a cylinder to force air through a bypass pathway around the piston with opening of the door.

It is thus a feature of at least one embodiment of the invention to provide a simple viscous damper without the need for viscous oils or the like which could leak or change in property with repeated heating cycles.

The damper may provide a one-way valve increasing a conductive area of the bypass pathway with an opening of the door.

It is thus a feature of at least one embodiment of the invention to provide a simple method of changing the damper operation depending on whether the door is opening or closing to prevent interference with the consumer during dispenser loading.

The piston may be an elastomeric seal and may include a shaft extending downwardly from the piston through the cylinder to a distal end.

It is thus a feature of at least one embodiment of the invention to orient the damper to cause water and contaminants such as might interfere with the piston to drain away from the piston during operation of the dishwasher.

The shaft may have a circumscribing diameter at least 10 percent smaller than a diameter of surrounding portions of the cylinder structure.

It is thus a feature of at least one embodiment of the invention to eliminate close tolerances between the shaft and the cylinder that could be subject to interference by detergent encrusted on the shaft or cylinder.

The lower end of the cylinder may be open to the wash cavity to permit entrance and exit of wash water into the cylinder between the cylinder and the shaft.

It is thus a feature of at least one embodiment of the invention to permit a self-cleaning of exposed elements of the damper.

The bypass path may be a channel on a piston shaft supporting the elastomeric seal and the elastomeric seal may slide along the piston shaft to change a conductive area of the channel depending on whether the door is being opened or closed.

It is thus a feature of at least one embodiment of the invention to incorporate the bypass valve into the elements of the piston and shaft for improved manufacturability.

The door may move linearly along slides in the housing and the cylinder may be incorporated into the door and the distal end of the shaft attached to the housing.

It is thus a feature of at least one embodiment of the invention to provide a damper well adapted to linear motion.

The distal end of the shaft may attach to the housing at a swivel coupling.

It is thus a feature of at least one embodiment of the invention to prevent binding in the motion of the piston caused by dimensional variations in the components during use or manufacture.

The cylinder may provide a continuous cylindrical cavity closed at an upper end and open at a lower end only.

It is thus a feature of at least one embodiment of the invention to provide a readily manufactured cylinder that is resistant to contamination and leakage.

Other features and advantages of the invention will become apparent to those skilled in the art upon review of the following detailed description, claims and drawings in which like numerals are used to designate like features.

DETAILED DESCRIPTION OF THE PREFERRED EMBODIMENT

Figure 1:
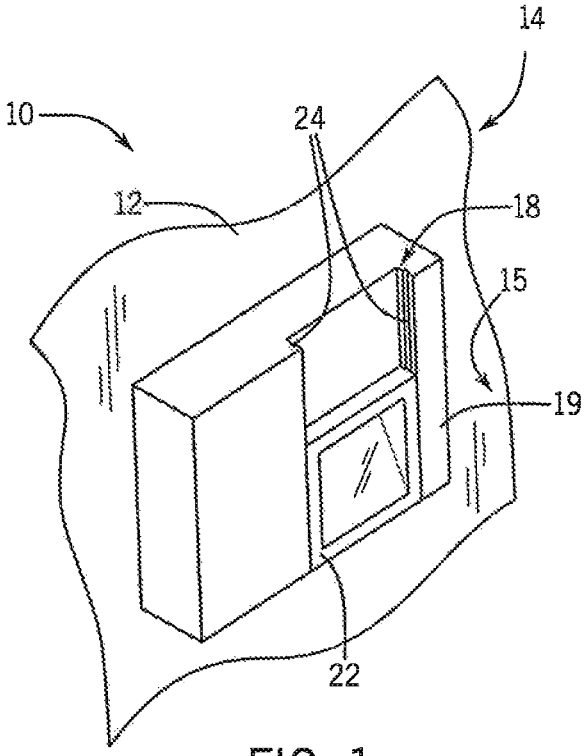
FIG. 1 is a fragmentary perspective view of an inner surface of the door of a dishwasher showing a detergent dispenser incorporating the present invention and having an upwardly sliding door shown in its downward position covering a dispenser cavity.

Referring now to FIG. 1, a dishwasher 10 may provide a door 12 having an inner surface 14 that abuts a wash cavity 15 into which dishes and cutlery may be placed for washing. The door 12 during the washing, will contain water spray which will run down the generally vertical inner surface 14.

Figure 2:
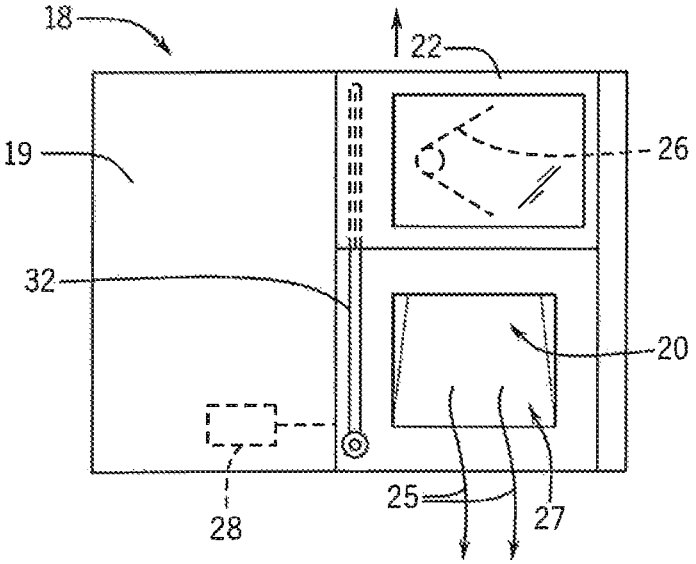
FIG. 2 is a front elevational view of the detergent dispenser of FIG. 1 showing the door in its upward position and showing a piston shaft of a damper assembly for reducing the speed of upward motion of the door.

Referring also to FIG. 2, a detergent dispenser 18 may have a housing 19 mounted on the inner surface 14 to provide a detergent chute 20 that may be covered by a sliding door 22 movable between a lower position shown in FIG. 1, covering the detergent chute 20 and sealing it from water ingress, and an elevated position shown in FIG. 2 opening the detergent chute 20 to allow detergent to be dispensed outward therefrom as indicated by arrows 25. In this regard, the detergent chute 20 may have a sloping rear wall 27 causing gravity to dispense the detergent into the wash cavity 15.

The sliding door 22 is constrained in its vertical motion by left and right vertical tracks 24 extending forward from the housing 19. An internal spring 26 (shown schematically) may bias the sliding door 22 to the upward position, and an electronic actuator 28 may retain the door in its lower position against the biasing force of the spring 26 until the electronic actuator 28 is released by an electrical signal whereupon the sliding door 22 will move upward. Electric actuator 28 may be a solenoid, wax motor, electric motor, bimetallic strip, or the like and will generally include a catch mechanism that allows the sliding door 22 to be slid downward and engaged by the electronic actuator 28 absent a signal releasing the electronic actuator 28.

Figure 3:
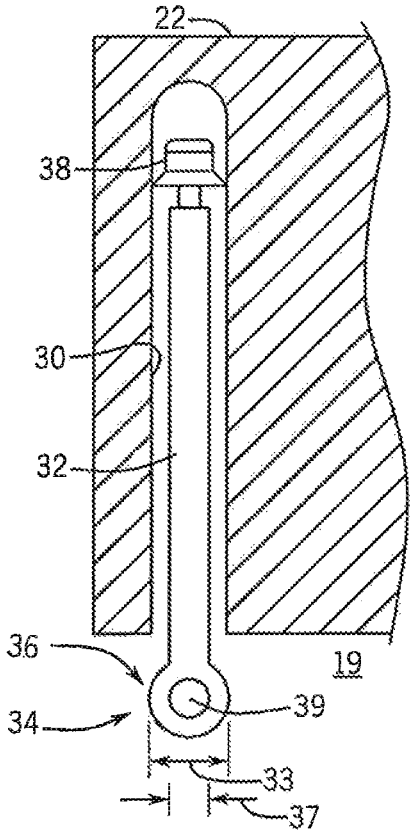
FIG. 3 is a fragmentary cross-section of the damper assembly of FIG. 2 showing an internal piston and the clearance around the piston shaft with respect to the damper cylinder allowing movement with encrustation of the shaft and a downward draining of liquid from the damper cylinder.

Referring also to FIG. 3, the door 22 may incorporate a vertically-extending damper cylinder 30 closed at an upper end and open at a bottom end and having a diameter 33. The damper cylinder 30 may receive a piston shaft 32 extending upwardly and attached to a stationary portion of a housing 19 by a pivot 34, for example, providing an eye 36 surrounding a cylindrical stud 39 extending forwardly from the housing 19 and allowing pivoting in one or more directions but restraining the piston shaft 32 against vertical motion with respect to the housing 19. Importantly, a diameter 37 of the piston shaft 32 will be substantially less than the diameter 33 of the cylinder 30 or any other surrounding portions of the door 22 by at least 10 percent to allow free clearance between the cylinder 30 and the piston shaft 32 preventing interference between these two elements should the piston shaft 32 be encrusted with detergent or the like. A gap between the cylinder 30 around the piston shaft 32 allows some degree of water scouring from the dishwasher of the lower edges of the cylinder 30 but substantially blocks water ingress to the upper reaches of the cylinder 30.

Figure 4A:
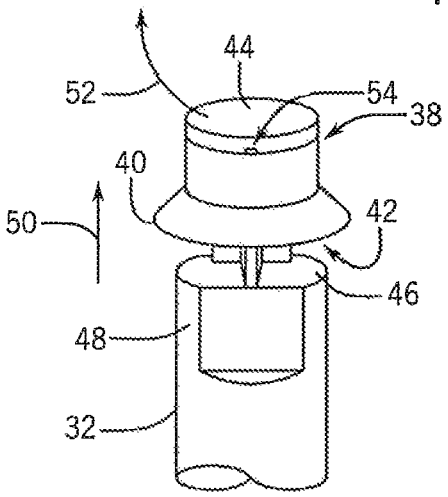
FIG. 4*a* is a fragmentary view of the piston on the piston shaft when the door is moving upward such as causes displaced air to move through a small orifice providing high damping action.
Figure 5B:
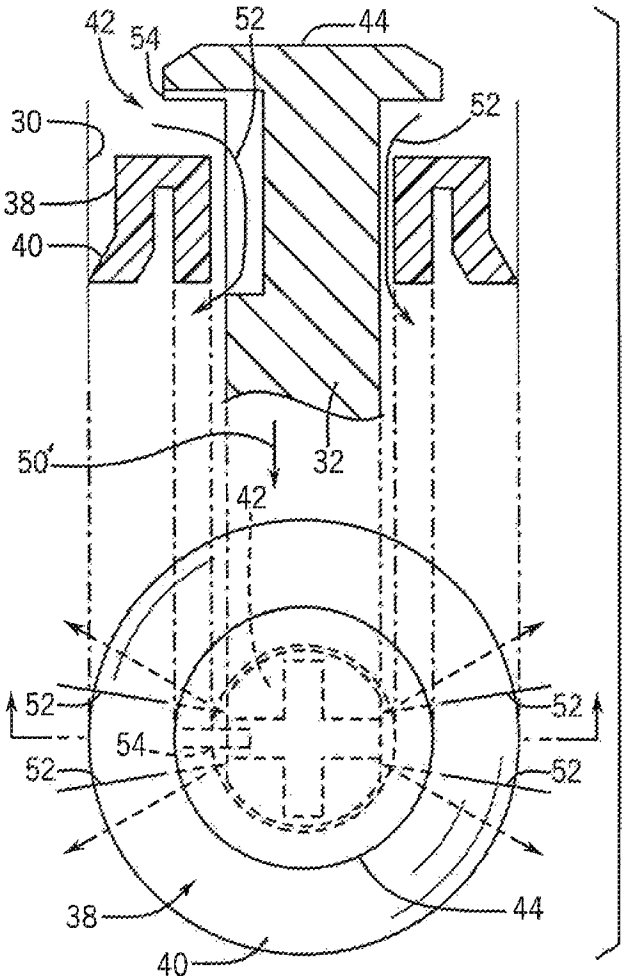
FIG. 5*b* is a figure similar to FIG. 4*b* showing a cross-section of the piston and piston shaft aligned with the top plan view of the piston and piston shaft showing constricted airflow around the piston in the bypass path with downward movement of the piston on the piston shaft when the dispenser door is being closed.
Figure 5A:
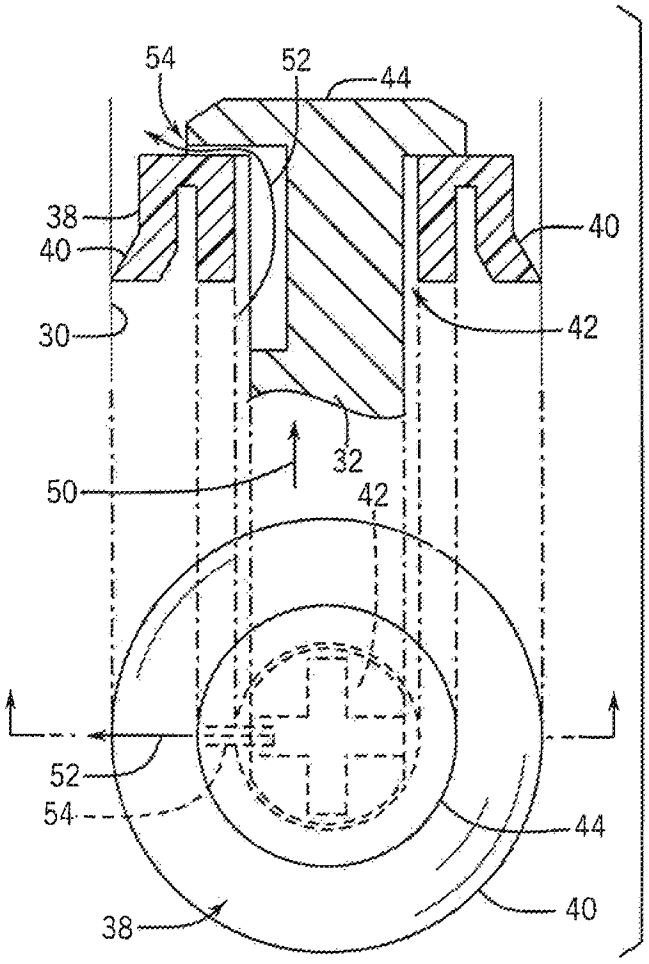
FIG. 5*a* is a figure similar to FIG. 4*a* showing a cross-section through the piston and piston shaft aligned with a top plan view of the piston and piston shaft and showing constriction of airflow around the piston in the bypass path with upward movement of the piston on the piston shaft when the dispenser door is being opened.

Referring now to FIGS. 3, 4*a* and 5*a*, an upper end of the piston shaft 32 within the cylinder 30 provides an elastomeric circular seal 38 having a radially-extending flange 40 that seals against the inner wall of the cylinder 30 to prevent airflow therearound.

The elastomeric seal 38 fits loosely about a reduced diameter journal portion 42 of the shaft 32 so that it may slide upward and downward on the journal portion 42 during motion of the shaft 32 and so that air may pass between the inner diameter of the elastomeric seal 38 and the piston shaft 32. The upward travel of the elastomeric seal 38 is limited by a cylindrical button stop 44 attached to the upper end of the journal portion 42 while the downward travel of the elastomeric seal 38 is limited by an increased diameter portion 46 of the shaft 32 having a greater diameter than the journal portion 42 in a front-to-back direction but an equal diameter to the journal portion 42 in a left-to-right direction (as depicted in FIG. 5) as provided by opposed flats 48.

When the sliding door 22 is moving upward, as indicated by arrow 50, the seal 38 will slide upward so that its upper edge contacts a lower surface of the button stop 44 sealing against the lower surface of the button stop 44 except at a small radially-extending notch 54 in the lower surface of the button stop 44. The outer periphery of the flange 40 seals against the inner surface of the cylinder 30 and accordingly no air can pass the seal 38 through the flange 40 or through most of the contact interface between the button stop 44 and the seal 38 except for through the notch 54. This sealing will cause a drawing of a vacuum in the upper portions of the cylinder 30 that is relieved only by airflow 52 passing through the notch 54 which forms a bypass channel. The size of this notch 54 is controlled to provide a high degree of viscous damping in the upward motion of the sliding door 22 that practically limits the speed of upward motion of the sliding door 22 by the airflow resistance through the notch 54. This speed limitation prevents a loud impact between the sliding door 22 and the housing 19 at the end of door motion.

As is understood in the art, viscous damping provides a retarding force that is proportional to the relative velocity of the damper elements, in contrast to, for example, frictional (Coulomb) damping which provides a velocity insensitive to a retarding force. In the case of viscous damping, the retarding force increases nonlinearly as a function of velocity, for example, as a cube function.

The upward motion of the sliding door 22 is consistent with the dispensing of detergent during the wash cycle when the sliding door 22 is released by the actuator 28. Accordingly, the damping of this upward motion reduces or eliminates noise caused by the end of travel of the sliding door 22 and its upward trajectory.

Figure 4B:
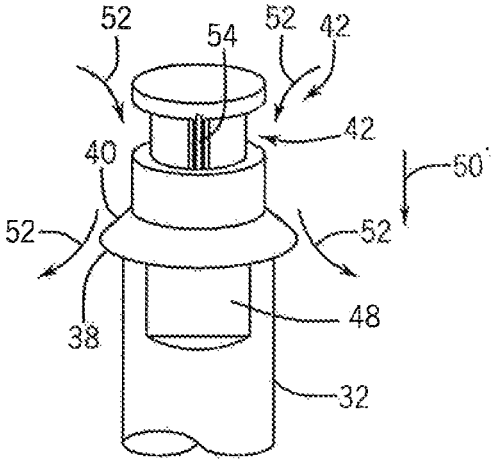
FIG. 4*b* is a figure similar to that of FIG. 4*a* showing a downward movement of the piston on the piston shaft when the door is moving downward such as opens larger channels for air to flow through, reducing damping action when the door is being shut.

Referring now to FIGS. 4*b* and 5*b*, in contrast to the situation when the door 22 is moved upward to release detergent, when the door 22 is moved downward indicated by arrow 50', the seal 38 slides downward on the journal portion 42 allowing larger amounts of airflow 52 passing under the button stop 44 and through the clearance between the seal 38 and the outer surfaces of the journal portion 42 providing a greatly increased cross-sectional area of bypass channel exhausting from the upper surface of the cylinder 30 above the seal 38. In this way, the sliding of the seal 38 provides an effective one-way valve that changes the degree of airflow as a function of direction of the sliding door 22 to allow lower resistive force and rapid closing of the door by the consumer when detergent is being installed in the detergent chute 20 but high damping when the door 22 wall opens upon release during the washing cycle.

Figure 6:
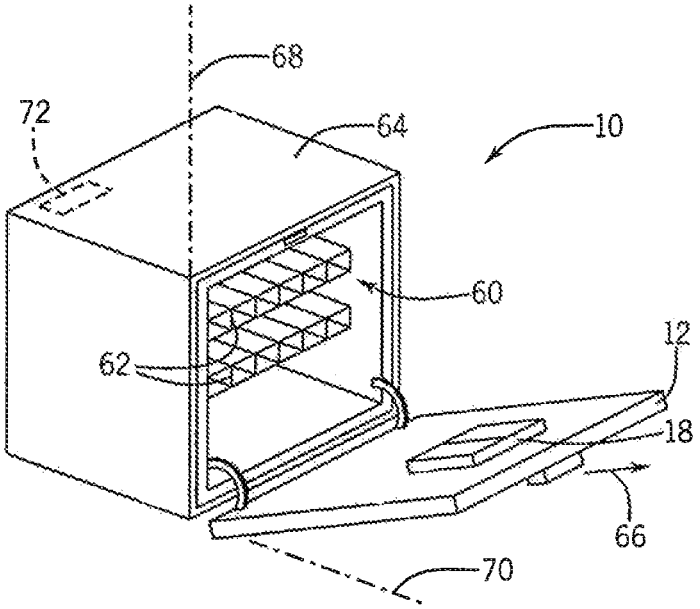
FIG. 6 is a perspective view of a wash cavity of a dishwasher showing the dishwasher housing and door when the door is in the opened position with the dispenser system of the present invention supported on an exposed inner surface of the door.

Referring now to FIG. 6, the dishwasher 10 holding the detergent dispenser 18 of the present invention may include a wash cavity 60 into which dishes and cutlery may be placed for washing on racks 62. The wash cavity 60 may be defined by a generally rectangular housing 64 open at a front surface to provide a sealable volume when covered by a dishwasher door 12. The dishwasher door 12 seals against a front lip of the housing 64 by means of a gasket or the like (not shown) when the dishwasher door 12 is in a vertical position with a door axis 66 of the dishwasher door 12 (parallel to a broad inner surface of the dishwasher door 12) aligned with vertical axis 68. The dishwasher door 12 may also open to a horizontal position with door axis 66 aligned along horizontal axis 70 for access to the wash cavity 60.

In the sealed position, the inner surface of the dishwasher door 12 is exposed to the wash cavity 60 and may support the detergent dispenser 18 on the inner surface of the dishwasher door 12 to dispense detergent directly into the wash cavity 60. When the dishwasher door 12 is in the open horizontal position, the detergent dispenser 18 is accessible to the user for refilling the detergent chute 20 with detergent.

A controller 72, for example, providing an electronic microprocessor communicating with a memory holding a stored program, may communicate with the standard electrical components of the dishwasher 10 including water pumps, heaters, and valves (not shown) to control them according to stored program wash cycles selectable by the user. In conjunction with these wash cycles, the controller 72 may control the detergent dispenser 18 for the dispensing of detergent. In this regard, the controller 72 will provide electrical signals to the detergent dispenser 18 to activate the actuator 28 to release detergent.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. A dishwasher detergent dispenser comprising:

a housing providing a detergent compartment adapted to be exposed to a wash chamber of the dishwasher during a washing cycle;

a door movable between a closed position covering the detergent compartment to contain detergent therein and an opened position exposing the detergent compartment to the wash chamber for release of detergent from the detergent compartment into the wash chamber;

a spring element urging the door from the closed position to the opened position;

an electrically controlled catch adapted to hold the door in the closed position against the urging of the spring element until activation and then to release the door to move to the door to the opened position;

a viscous damper attached between the door and the housing to provide a damping force limiting opening speed of the door; and wherein the viscous damper defines a door opening damping force and a door closing damping force, with the door opening damping force being greater than the door closing damping force so that closing the door requires less force than opening the door.

2. The dishwasher detergent dispenser of claim 1 wherein the viscous damper includes a piston and a cylinder configured to reciprocate with respect to each other to provide the door opening damping force and the door closing damping force.

3. The dishwasher detergent dispenser of claim 2 wherein the piston and the cylinder of the viscous damper provide a pneumatic damper to force air through a bypass pathway around the piston with opening of the door.

4. A dishwasher detergent dispenser comprising:

a housing providing a detergent compartment adapted to be exposed to a wash chamber of the dishwasher during a washing cycle;

a door movable between a closed position covering the detergent compartment to contain detergent therein and an opened position exposing the detergent compartment to the wash chamber for release of detergent from the detergent compartment into the wash chamber;

a spring element urging the door from the closed position to the opened position;

an electrically controlled catch adapted to hold the door in the closed position against the urging of the spring element until activation and then to release the door to move to the door to the opened position;

a viscous damper attached between the door and the housing to provide a damping force limiting opening speed of the door;

wherein the viscous damper provides a reduced damping force limiting closing speed of the door, the reduced damping force being less than the damping force limiting opening speed of the door;

wherein the viscous damper is a pneumatic damper providing a piston fitting within a cylinder to force air through a bypass pathway around the piston with opening of the door; and further including a one-way valve increasing a conductive area of the bypass pathway with an opening of the door.

5. The dishwasher detergent dispenser of claim 3 wherein the piston is an elastomeric seal and includes a shaft extending downwardly from the piston through the cylinder to a distal end, the shaft having a diameter smaller than a diameter of each of the piston and the cylinder.

6. The dishwasher detergent dispenser of claim 5 wherein the cylinder is open to the dishwasher cavity at a lower end of the cylinder as the housing is oriented during a washing of the dishes.

7. The dishwasher detergent dispenser of claim 6 wherein the lower end of the cylinder is open to the wash cavity to permit entrance and exit of wash water into the cylinder between the cylinder and the shaft.

8. The dishwasher detergent dispenser of claim 5 wherein the bypass path is a channel on a piston shaft supporting the elastomeric seal and wherein the elastomeric seal may slide along the piston shaft to change a conductive area of the channel depending on whether the door is being opened or closed.

9. The dishwasher detergent dispenser of claim 5 wherein the door moves linearly along slides in the housing and wherein the cylinder is incorporated into the door and the distal end of the shaft attaches to the housing.

10. The dishwasher dispenser of claim 9 wherein the distal end of the shaft attaches to the housing at a swivel coupling.

11. The dishwasher detergent dispenser of claim 5 wherein the cylinder provides a continuous cylindrical cavity closed at an upper end and opened at a lower end only.

12. A dishwasher comprising:

a wash cavity having an opening size to receive dishes therethrough for cleaning;

a door releasably positionable to cover the opening for retaining water within the wash cavity during a washing cycle, the door presenting a wall extending vertically and facing the wash cavity when the door covers the opening and extending horizontally when the door is fully open and not covering the opening;

a water handling system conducting water through the wash cavity during a washing cycle washing dishes contain therein; and a dishwasher detergent dispenser affixed to the wall of the door and including:

a housing providing a detergent compartment adapted to be exposed to a wash chamber of the dishwasher during a washing of dishes;

a dispenser door movable between a closed position covering the detergent compartment to contain detergent therein and an opened position exposing the detergent compartment to the wash chamber for release of detergent from the detergent compartment into the wash chamber;

a spring element urging the dispenser door from the closed position to the opened position;

an electrically controlled catch adapted to hold the dispenser door in the closed position against the urging of the spring element until activation and then to release the dispenser door to move to the opened position; and a viscous damper attached between the dispenser door and the housing to provide a damping force limiting opening speed of the dispenser door; the viscous damper including:

a notch with a variable size opening that is:

smaller during door opening to provide a greater resistance to door movement during door opening; and larger during door closing to provide a lesser resistance to door movement during door closing.

13. The dishwasher of claim 12 wherein the viscous damper is a pneumatic damper providing a piston fitting within a cylinder to force air through the variable size opening defined by a bypass pathway around the piston with opening of the door.

14. The dishwasher of claim 13 wherein the piston is an elastomeric seal and includes a shaft extending downwardly from the piston through the cylinder to a distal end.

15. The dishwasher of claim 14 wherein the shaft has a diameter at least 10 percent smaller than an inside diameter of the cylinder.

16. The dishwasher detergent dispenser of claim 15 wherein a lower end of the cylinder is open to the wash cavity to permit entrance and exit of wash water into the cylinder between the cylinder and the shaft.

17. The dishwasher detergent dispenser of claim 14 wherein the bypass path is a channel on a piston shaft supporting the elastomeric seal and wherein the elastomeric seal may slide along the piston shaft to change a conductive area of the channel depending on whether the door is being opened or closed.

18. The dishwasher detergent dispenser of claim 14 wherein the door moves linearly along slides in the housing and wherein the cylinder is incorporated into the door and a distal end of the shaft attaches to the housing and wherein the distal end of the shaft attaches to the housing at a swivel coupling.

19. The dishwasher detergent dispenser of claim 14 wherein the cylinder provides a continuous cylindrical cavity closed at an upper end and opened at a lower end only.

* * * * *